US005515249A

United States Patent [19]

Shiao

[11] Patent Number: 5,515,249

[45] Date of Patent: May 7, 1996

[54] HAND TOOL SET WITH AN ILLUMINATOR

[76] Inventor: Hsuan-Sen Shiao, No. 20, Alley 235, Fu-Shang Lane, Taichung, Taiwan

[21] Appl. No.: 402,521

[22] Filed: Mar. 10, 1995

[51] Int. Cl.[6] ..... B25B 23/18; B25B 15/00; F21V 331/00

[52] U.S. Cl. ..... 362/119; 362/154; 362/253; 362/201; 7/165

[58] Field of Search ..... 362/119, 120, 362/154, 253, 108, 200, 201; 7/165

[56] References Cited

U.S. PATENT DOCUMENTS

| | | | |
|---|---|---|---|
| 1,283,566 | 11/1918 | Rosenfeld | 362/201 |
| 2,992,487 | 7/1961 | Miller | 362/119 |
| 4,283,757 | 8/1981 | Nalbandian et al. | 362/119 |
| 4,302,797 | 11/1981 | Cooper | 362/119 |

FOREIGN PATENT DOCUMENTS

| | | | |
|---|---|---|---|
| 501478 | 3/1951 | France | 362/120 |
| 61488 | 12/1954 | France | 362/120 |
| 852600 | 7/1949 | Germany | 362/154 |
| 967765 | 8/1964 | United Kingdom | 362/119 |

*Primary Examiner*—Ira S. Lazarus
*Assistant Examiner*—Alfred Basichas
*Attorney, Agent, or Firm*—Bacon & Thomas

[57] ABSTRACT

A hand tool set including a casing formed of two hinged shells to hold a handle and a full set of tool bits, and a lamp assembly mounted in a lamp chamber inside the casing, wherein the handle can be removed from the casing and attached to a polygonal hole at one end of the casing to hold one tool bit for turning screws; the lamp assembly has a self-provided battery power supply and is controlled by a press button to illuminate the workpiece.

2 Claims, 3 Drawing Sheets

HAND TOOL SET WITH AN ILLUMINATOR

BACKGROUND OF THE INVENTION

The present invention relates to screw holding and driving tools, and relates more particularly to such a hand tool set which carries an illuminator and, which is capable of holding and driving screws of different specifications.

For holding or driving screws of different specifications, different screwdrivers or like means should be used. However, it is inconvenient to carry with oneself a full set of screwdrivers different specifications. Furthermore, if to turn a screw in a narrow, dark place, the job is difficult to proceed without illumination.

SUMMARY OF THE INVENTION

The present invention provides a hand tool set with an illuminator which comprises a casing to carry a handle and a full set of tool bits, and a lamp assembly mounted in a lamp chamber inside the casing. The handle can be removed from the casing and attached to a polygonal hole at one end of the casing to hold one tool bit for turning screws. The lamp assembly has a self-provided battery power supply and is controlled by a press button, which extends out of a button hole on the casing, to illuminate the workpiece.

DETAILED DESCRIPTION OF THE PREFERRED EMBODIMENT

Figure 1:
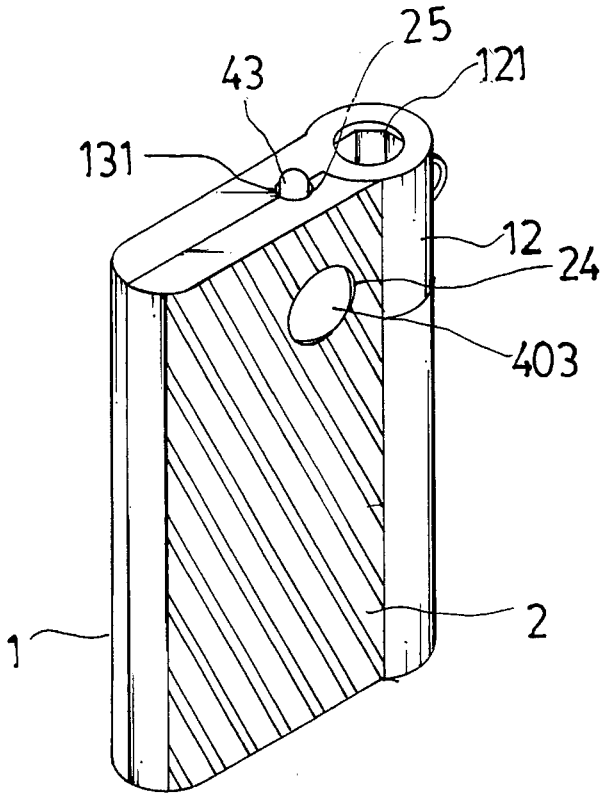
FIG. 1 is an elevational view of a hand tool se according to the present invention.
Figure 2:
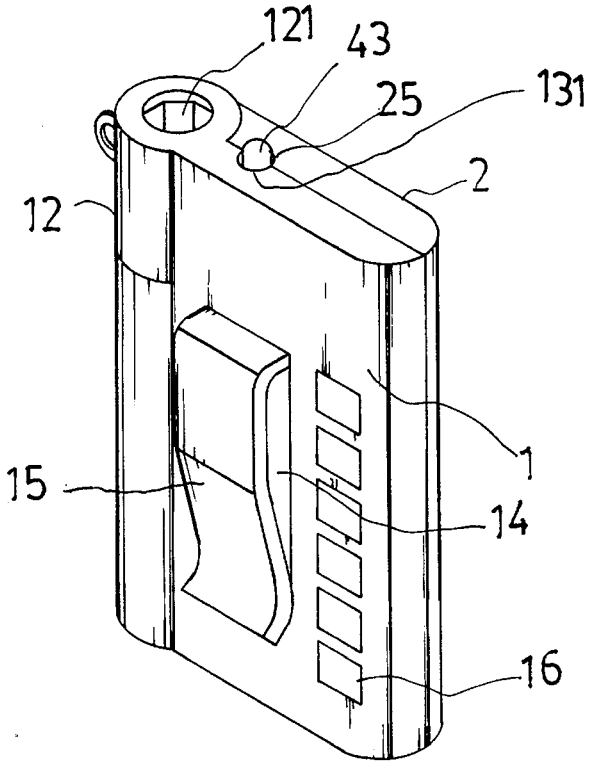
FIG. 2 is a back side view of the hand tool set shown in FIG. 1.
Figure 3A:
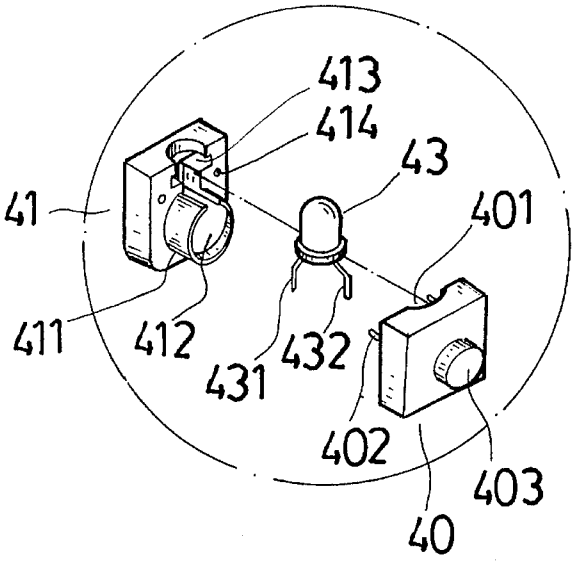
FIG. 3A is an exploded view of the lamp assembly for the hand tool set shown in FIG. 1.
Figure 3:
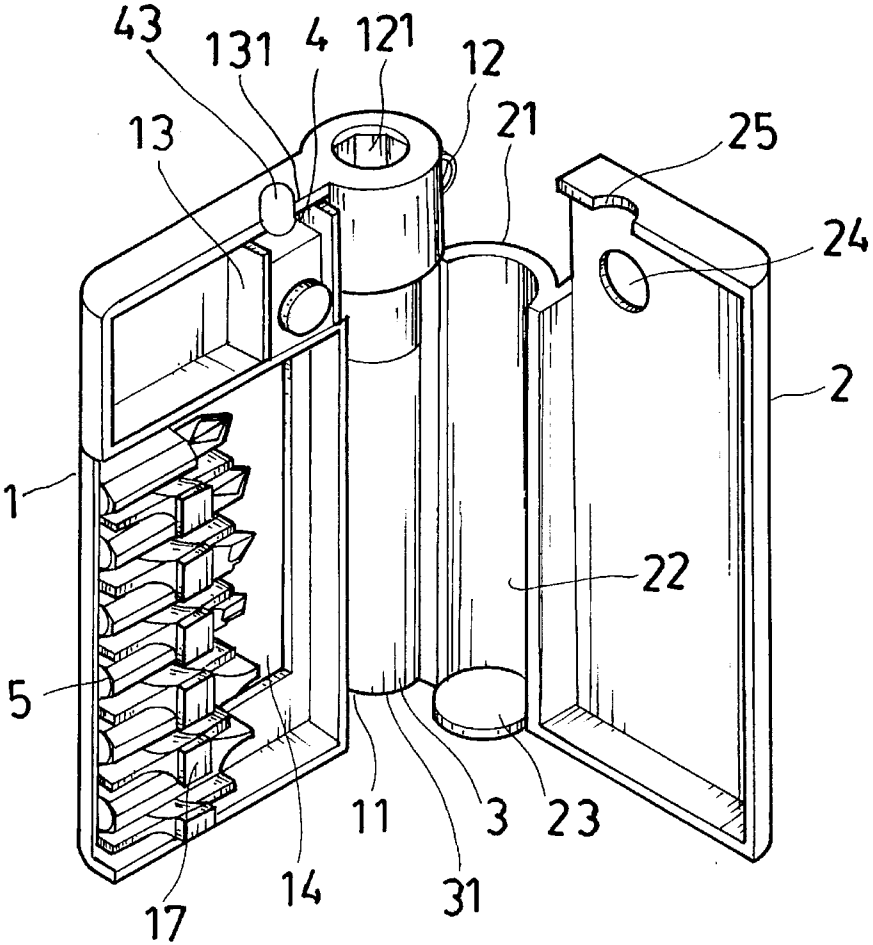
FIG. 3 shows the internal arrangement of the hand tool set shown in FIG. 1.

Referring to FIGS. 1, 2, and 3, a hand tool set is shown comprised of a bottom shell 1 and a top shell 2 hinged together. The bottom shell 1 comprises a barrel 12 and an arched coupling portion 11 aligned at one side, a lamp chamber 13 adjacent to the barrel 12, a top opening 131 communicated with the lamp chamber 13, a lamp assembly 4 mounted within the lamp chamber 13, a handle 3 received in the arched coupling portion 11, a center opening 14, a back clip 15 extended backwards from the top side of the center opening 14 for fastening, a row of tool bit compartments 16 at the front side, and retaining blocks 17 respectively raised between each two adjacent tool bit compartments 16 for holding tool bits 5 in the tool bit compartments 16 respectively. The barrel 12 defines a polygonal hole 121, which receives one end of the handle 3. The handle 3 has one end detachably fitted into the polygonal hole 121, and an opposite end made with a polygonal bit mounting hole 31 for holding a bit 5. The top shell 2 comprises a coupling portion 21 hinged to the coupling portion 11 of the bottom shell 1 and defining a longitudinal receiving space 22 for receiving the handle 3, a top plate 23 at one end of the coupling portion 11 for holding the handle 3 within the coupling portions 11 and 21, a top opening 25 corresponding to the top opening 131 on the bottom shell 1, and a button hole 24 corresponding to the lamp chamber 13 on the bottom shell 1.

Referring to FIG. 3A, the lamp assembly 4 comprises a base 41, a cover 40, and a LED (light emitting diode) 43. The cover 40 and the base 41 are molded from flexible plastics. The base 41 comprises a battery holder 411, which holds a battery 412, a T-groove 413 extended from the battery holder 411, and two pin holes 414 at two opposite sides by the T-groove 413. The cover 40 comprises a T-groove 401 at the back side matching with the T-groove 413 on the base 41, two upright pins 402 bilaterally raised from the back side and respectively fitted into the pin holes 414 on the base 41, and a press button 403 disposed at the front side. The LED 43 is mounted within the T-grooves 401 and 413. When assembled, the two contact legs 431 and 432 of the LED 43 are disposed adjacent to the two opposite terminals of the battery 24. When the lamp assembly 4 is installed in the lamp chamber 13, the LED 43 extends out of the top openings 131 and 25, and the press button 403 extends out of the button hole 24 on the top shell 2.

Figure 4:
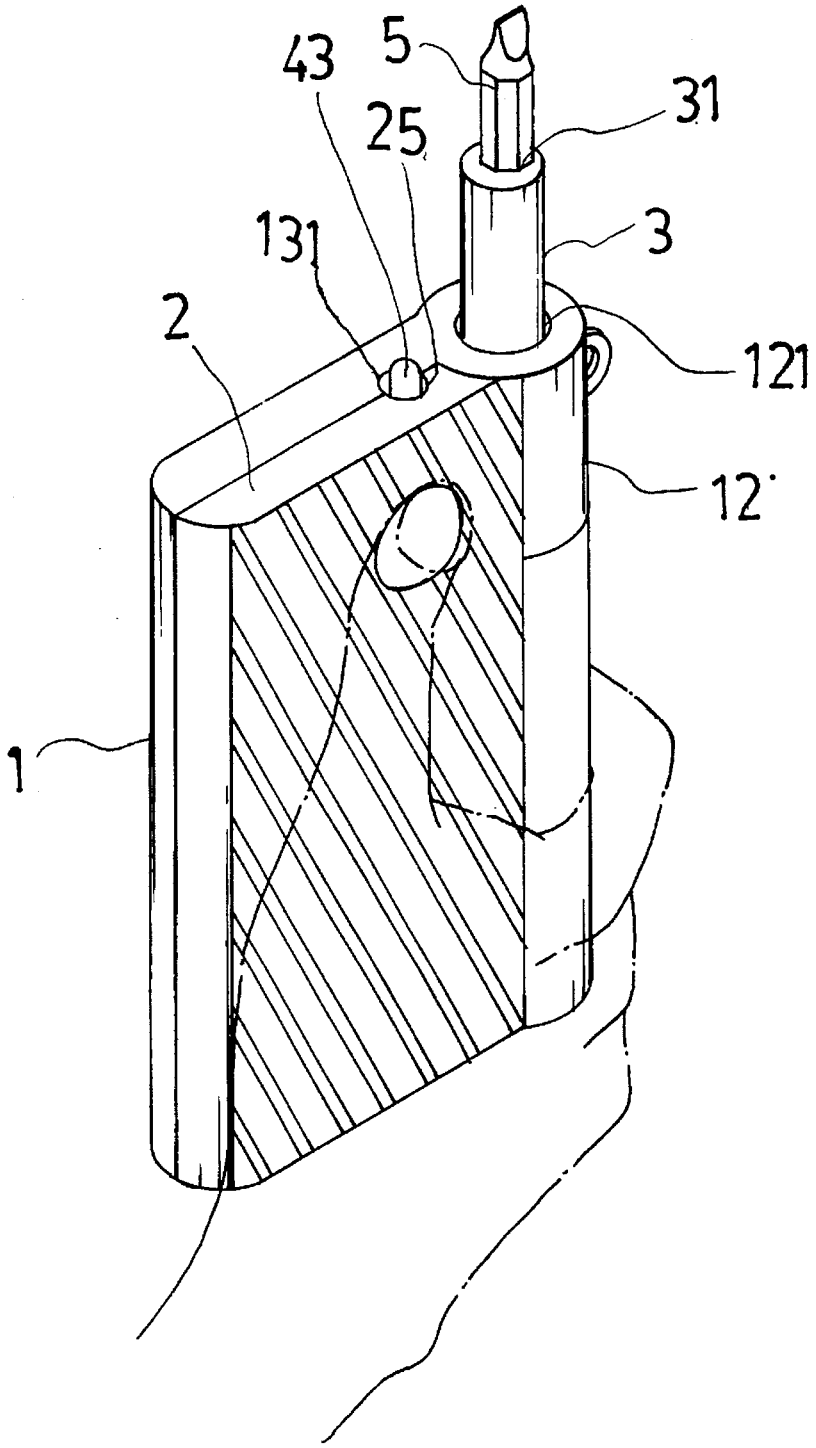
FIG. 4 shows an application example according to the present invention.

Referring to FIG. 4, the handle 3 can be removed from the coupling portions 11 and 21 and then fitted into the polygonal hole 121 of the barrel 12 to hold a tool bit 5 for driving screws. When the press button 403 is depressed, the two contact legs 431 and 432 of the LED 43 are forced to contact the two opposite terminals of the battery 412, and therefore the LED 43 is turned on.

I claim:

1. A hand tool set comprising;

a bottom shell having a barrel and an arched coupling portion aligned at one side, a lamp chamber adjacent to said barrel, a center opening, a row of tool bit compartments at a front side thereof, and a plurality of retaining blocks respectively raised between each two adjacent tool bit compartments for holding tool bits in said tool bit compartments, said barrel defining a polygonal hole;

a top shell having an arched coupling portion hinged to the coupling portion of said bottom shell and having a top plate at one end remote from said barrel, and a button hole at a front side thereof corresponding to said lamp chamber;

a handle received within the coupling portions of said bottom shell and said top shell and retained between said stop plate and said barrel, said handle having a polygonal mounting portion at one end for fitting into the polygonal hole on said barrel, and a polygonal bit mounting hole at an opposite end for holding a tool bit; and a lamp assembly mounted within said lamp chamber, said lamp assembly comprising a base, a cover fastened to said base, and a light source retained between said base and said cover and extended out of said lamp chamber, said base comprising a T-groove, a battery holder, which holds a battery, and two pin holes, said cover comprising a T-groove matching with the T-groove on said base, two upright pins respectively fitted into said pin holes, and a press button extended out of said button hole on said top shell, said light source having two opposite contact legs respectively disposed adjacent to the two opposite terminals of said battery such that said light source is turned on when said press button is depressed, or turned off when said press button is released.

2. The hand tool set of claim 1 wherein said bottom shell further comprises a back clip extended backwards from a top side of the center opening on said bottom shell for fastening.

* * * * *